US006087916A

United States Patent [19]

Kutkut et al.

[11] Patent Number: 6,087,916

[45] Date of Patent: Jul. 11, 2000

[54] COOLING OF COAXIAL WINDING TRANSFORMERS IN HIGH POWER APPLICATIONS

[75] Inventors: Nasser H. Kutkut; Deepakraj M. Divan; John G. Wohlbier; Randal W. Gascoigne, all of Madison, Wis.

[73] Assignee: Soft Switching Technologies, Inc., Middleton, Wis.

[21] Appl. No.: 08/692,810

[22] Filed: Jul. 30, 1996

[51] Int. Cl.[7] ..... H01F 27/08; H01F 27/28

[52] U.S. Cl. ..... 336/61; 336/195; 336/223

[58] Field of Search ..... 336/61, 223, 195

[56] References Cited

U.S. PATENT DOCUMENTS

| | | | |
|---|---|---|---|
| 3,717,808 | 2/1973 | Horna . | |
| 3,725,741 | 4/1973 | Misencik | 317/18 D |
| 3,835,430 | 9/1974 | Kocsis | 336/83 |
| 3,961,292 | 6/1976 | Davis | 333/32 |
| 3,965,378 | 6/1976 | Liebe et al. | 310/65 |
| 4,134,091 | 1/1979 | Rogers | 336/61 |
| 4,151,547 | 4/1979 | Rhoades et al. | 357/81 |
| 4,222,016 | 9/1980 | Stock et al. | 333/24 R |
| 5,157,319 | 10/1992 | Klontz et al. | 320/2 |
| 5,210,513 | 5/1993 | Khan et al. | 336/61 |
| 5,301,096 | 4/1994 | Klontz et al. | 363/37 |
| 5,341,083 | 8/1994 | Klontz et al. | 320/2 |
| 5,341,280 | 8/1994 | Divan et al. | 363/37 |
| 5,341,281 | 8/1994 | Skibinski | 363/39 |

OTHER PUBLICATIONS

Product literature for Isostrate thermally conductive electrical insulators by Power Devices, Inc. (no date).

Product literature for Sil–Pad by the Bergquist Company, 1994.

Product literature for Softface thermal interface by the Bergquist Company, 1995.

*Primary Examiner*—Michael L. Gellner

*Assistant Examiner*—Anh Mai

*Attorney, Agent, or Firm*—Foley & Lardner

[57] ABSTRACT

A coaxial winding transformer is cooled by having heat transfer members connected to an outer conductor of the transformer to receive heat therefrom. The heat transfer members form a heat transfer conducting path from the outer conductor of the transformer to a surface of a heat sink. The heat sink may have fins to maximize transfer of the heat from the heat sink to the ambient air. The outer conductor can include a metal strap member in contact with the surface of extending sections of tubular straight leg sections to electrically connect the tubular sections and transfer heat therefrom. Heat is then transferred from the strap of the outer conductor through the heat transfer members to an available surface of the heat sink. A layer of heat conducting and electrically insulating material may be mounted between the heat sink and the heat transfer members to allow transfer of heat to the heat sink while maintaining electrical isolation of the transformer from the heat sink, or the heat sink may be electrically isolated from other components. Heat generated in magnetic cores mounted about the straight legs of the transformer may also be transferred to the heat sink using a metal strap in contact with the outer surface of the magnetic cores, with base sections of the strap in heat transfer contact with the heat sink.

17 Claims, 9 Drawing Sheets

FIG. 1A
(PRIOR ART)
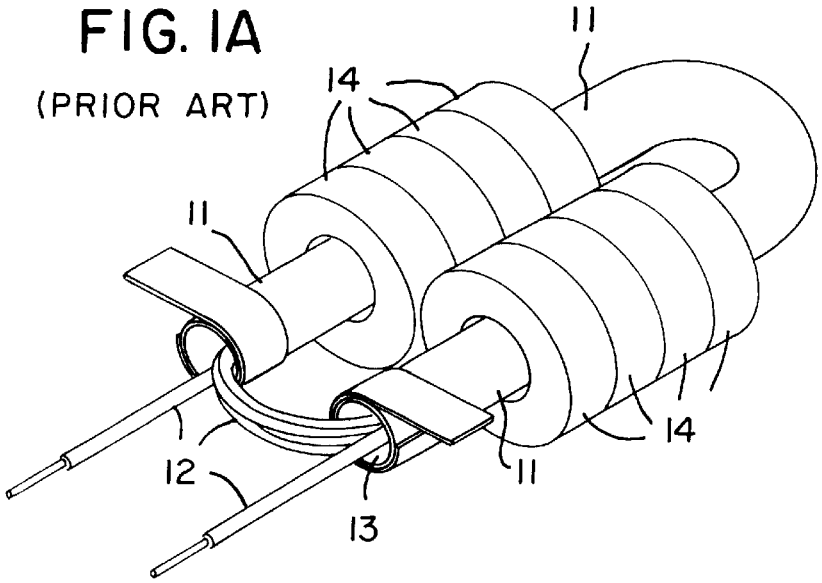
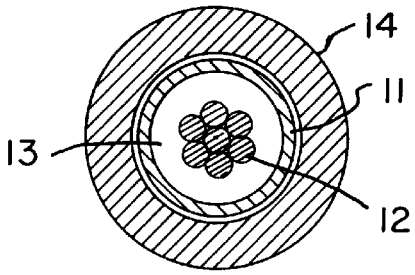
FIG. 1B
(PRIOR ART)
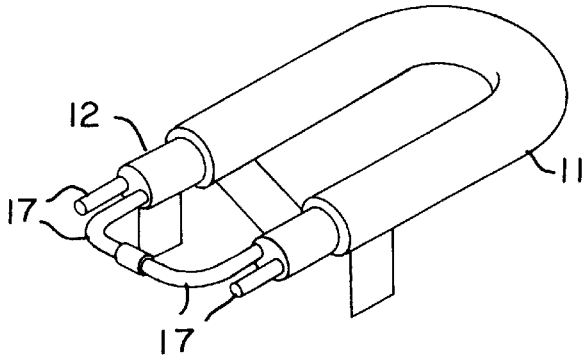
FIG. 2
(PRIOR ART)

COOLING OF COAXIAL WINDING TRANSFORMERS IN HIGH POWER APPLICATIONS

FIELD OF THE INVENTION

This invention pertains generally to the field of electronic systems and the cooling of power transformers therein, and particularly to the cooling of coaxial winding transformers.

BACKGROUND OF THE INVENTION

Modern power electronic systems are typically used to convert the electrical energy received from a power source to the form (e.g., frequency or voltage level) demanded by a load. The electronic power circuits are composed of various components, including both active semiconductor switching devices and passive components such as capacitors, inductors, and, typically, one or more transformers. Because power electronic systems handle relatively large amounts of power, energy is lost in both the active and passive components of the power system; the energy lost is dissipated in the form of heat which must be removed from the enclosure within which the power electronic components are packaged. The efficient removal of heat from the passive and active components is important to maintain the temperature in the enclosure within normal operating temperature specifications for the components to allow their efficient operation and to enhance their operating lifetime.

A type of transformer that is becoming more widely used in high output current power electronic systems is the coaxial winding transformer (CWT). The performance of coaxial winding transformers is superior to that of conventionally wound transformers in many high power, high frequency applications. The coaxial winding transformer exhibits relatively low, and well controlled, leakage inductance and has high power densities. A perspective view of a typical prior coaxial winding transformer is shown in FIG. 1A, and a cross-section through a leg of the transformer is shown in FIG. 1B. The structure of the coaxial winding transformer includes an outer conductor 11, coaxially wound inner conductor(s) 12, an interwinding space 13, which may be filled with insulating material, and, typically, a toroidal magnetic core 14 (or several cores) mounted around the outer conductor 11. When a voltage is applied to the outer winding 11 (typically a copper tube), acting as the primary, a magnetizing current will flow in, and hence a magnetizing flux is produced by, the outer winding. The resulting flux will be tangential to circular paths outside the outer winding, and all the flux produced by the outer winding links the inner winding 12 and induces a voltage proportional to the applied voltage times the turns ratio. The inverse is essentially true when the relative permeability of the core 14 is many times the permeability of the interwinding space 13.

A significant feature of the coaxial winding transformer is that substantially no leakage field is produced by the outer winding since all of the flux produced by this winding links the inner winding. Consequently, unlike conventional winding transformers, the only flux component that penetrates the core is the magnetizing flux, allowing optimal utilization of the magnetic core. The leakage inductance is a function of the interwinding space, and can be minimized by minimizing this space.

Like any electrical component, some losses will inevitably occur in a coaxial winding transformer as power is transmitted across the primary to the secondary. The lost energy is converted to heat. Where the coaxial winding transformer is carrying very high currents, the heat dissipated in the transformer can be significant and can require that provisions be made for removing this heat from the transformer. The fact that the outer transformer winding of a coaxial winding transformer is typically made of a metal tube provides some degree of natural cooling of the transformer, although substantial portions of the outer conductor are typically surrounded by the cores 14. The rate of cooling may not be sufficient, particularly if the transformer is driven at very high power levels. For example, it is a particular advantage of the coaxial winding transformer that because no leakage flux penetrates the magnetic core, the current, and hence the power level, of the transformer can be increased without requiring that the size of the transformer be increased. Nonetheless, a coaxial winding transformer of a given size driven at very high currents and high power levels will naturally run hotter than a larger coaxial winding transformer operated at the same power level, and, of course, will have a smaller outer conductor surface area from which heat can be dissipated. One prior cooling approach, illustrated in FIG. 2, is to provide cooling tubes 17 which extend through the interior of the coaxial transformer, with a coolant liquid pumped through the tubes 17 and to a heat exchanger (not shown) to draw heat away from the transformer. Although this is an effective way of cooling the transformer windings, the cost of this approach is rather high due to the need for an active closed loop liquid cooling circuit.

SUMMARY OF THE INVENTION

In accordance with the present invention, a coaxial winding transformer structure with cooling has a significantly enhanced ability to dissipate heat generated in the transformer, using passive heat transfer components and direct transfer of heat to the ambient air. The heat transfer structure of the coaxial winding transformer of the invention transfers heat from the outer winding conductor of the transformer via passive heat transfer members to a position away from the transformer where the heat may be transferred to a heat sink. The heat sink is mounted so that the heat transferred from the transformer to the heat sink can be dissipated to the ambient air away from the transformer itself, and preferably to ambient air outside of an enclosure for the transformer and the other electrical and electronic components that may be associated with the transformer. Heat transfer members may also be utilized to transfer heat from the magnetic cores of the transformer to the heat sink. The heat transfer path from the outer winding of the transformer to the heat sink can be formed, if desired, to maintain electrical isolation of the heat sink from the transformer.

In accordance with the present invention, the coaxial transformer includes an inner winding conductor and a coaxial outer winding conductor, the outer conductor formed of metal and having a cylindrical outer surface. The inner winding conductor of the coaxial winding transformer may be formed with one or more turns, each turn having two generally straight legs and bends between the legs, with the outer conductor formed as two straight leg sections extending around the straight legs of the inner conductor and connected together at one end by a conducting member. In the present invention, one or more heat transfer members are mounted to make heat transfer contact with the outer conductor, preferably by making contact with a large portion of an available surface area of the outer conductor of the transformer. A heat transfer path from the outer winding conductor to a metal heat sink is formed by one or more heat transfer members. The heat sink may be formed of a metal base from which extend heat transfer fins that facilitate rapid transfer of heat away from the fins into the ambient air. The heat sink may be isolated or insulated from other circuit components and the chassis so that the outer conductor and the heat sink may be electrically connected together. Alternatively, the heat transfer member or members may include a heat conducting, electrically insulating element therein to provide electrical isolation between the transformer and the heat sink. Preferred insulating elements include various polymer sheet materials which have good electrical insulation properties but nonetheless provide good heat transfer across a layer of such electrical insulator.

The outer conductor preferably includes semicylindrical extending sections which extend beyond the cylindrical straight leg sections of the outer conductor of the transformer. The semicylindrical extending sections extend at one end to a position where they can be connected to a metal strap member forming a section of the outer conductor; the strap member is preferably mounted to be in firm contact with the entire available outer surface area of the semicylindrical sections to provide a large area across which electrical conduction and efficient heat transfer can occur. The strap member completes the electrical circuit between the two straight leg sections of the outer conductor. The strap may then be connected to the heat sink for heat transfer thereto, either directly or through intermediate heat transfer members—for example, to a block of metal having one of its surfaces in contact with a surface of the heat sink or with a flat surface portion of the strap and its opposite surface in contact with a layer of electrically insulating heat transfer polymer which is itself mounted to a surface of the heat sink. In this manner, transfer of heat from the outer conductor of the transformer to a heat transfer member, and then from one heat transfer member to another, takes place at large areas of contact to maximize the rate of heat flow. Heat transfer members may be connected to the outer conductor at both ends of the transformer—the closed end at which the straight legs of the outer conductor are connected together by the strap and the open end—to maximize the rate of flow of heat from the transformer to the heat sink.

The coaxial winding transformer generally includes magnetic cores mounted around the straight tubular leg sections of the outer conductor. These cores typically take the form of toroids of rectangular cross-section. The inner diameter of each core is preferably formed to be slightly larger than the outer diameter of the outer conductor so that the cores fit closely over the straight legs of the outer conductor.

Because some heat is transferred to the cores from the outer surface of the outer conductor and because some heat is generated in the cores themselves, the invention further preferably includes a heat transfer member formed, e.g., as a strap which extends over the cores on both legs of the transformer and in contact with a large portion of the surface area of the cores along the outer sides of the cores, to provide good heat transfer from the cores to the heat conductive strap. The heat conductive strap extends from the cores to a base portion of the strap which is mounted to be in good heat transfer contact with the heat sink. The base portion of the strap preferably contacts a fairly large area of the available heat sink surface to maximize heat transfer to the heat sink. If desired, a layer of heat conductive, electrical insulating material may be mounted between the base portion(s) of the heat transfer strap and the heat sink surface to provide electrical isolation of the cores from the heat sink. The strap also conveniently serves to secure the transformer to the heat sink.

The transformer may be mounted to an available surface of one side of a base section of the heat sink, with fins extending from the opposite side of the heat sink base to allow maximum heat transfer to air flowing past the fins. The transfer of heat away from the fins may be enhanced, if desired, by providing a fan or other mechanism for blowing air past the fins. If desired, the transformer side of the heat sink can be sealed within an enclosure so that the transformer is sealed off from the outside air, while the heat transfer fins on the other side of the heat sink are exposed to the ambient air to allow heat transfer thereto to take place.

Further objects, features and advantages of the invention will be apparent from the following detailed description when taken in conjunction with the accompanying drawings.

BRIEF DESCRIPTION OF THE DRAWINGS

In the drawings:

FIG. 1A is a perspective view of a conventional (prior art) coaxial winding transformer structure.

FIG. 1B is a cross-sectional view of a conventional (prior art) coaxial winding transformer structure as in FIG. 1A.

FIG. 2 is a perspective view of a coaxial winding transformer in accordance with the prior art which utilizes liquid cooling tubes extending through the transformer to allow withdrawal of heat from the transformer by circulating coolant within the transformer.

DETAILED DESCRIPTION OF THE INVENTION

Figure 3:
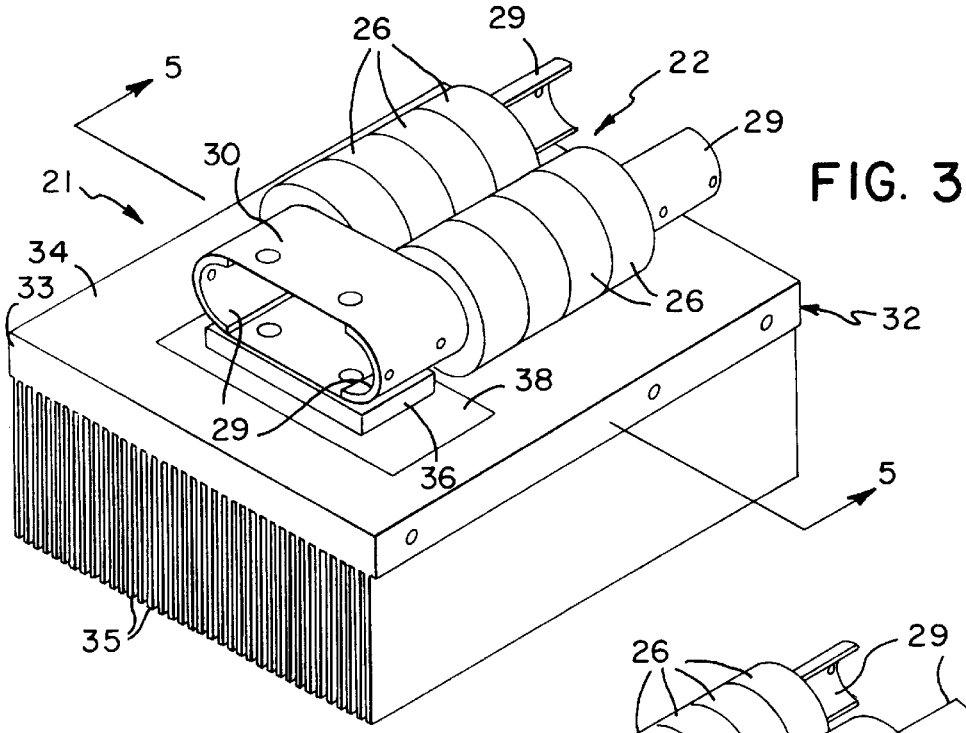
FIG. 3 is a perspective view of a coaxial winding transformer structure with cooling in accordance with the invention.
Figure 5:
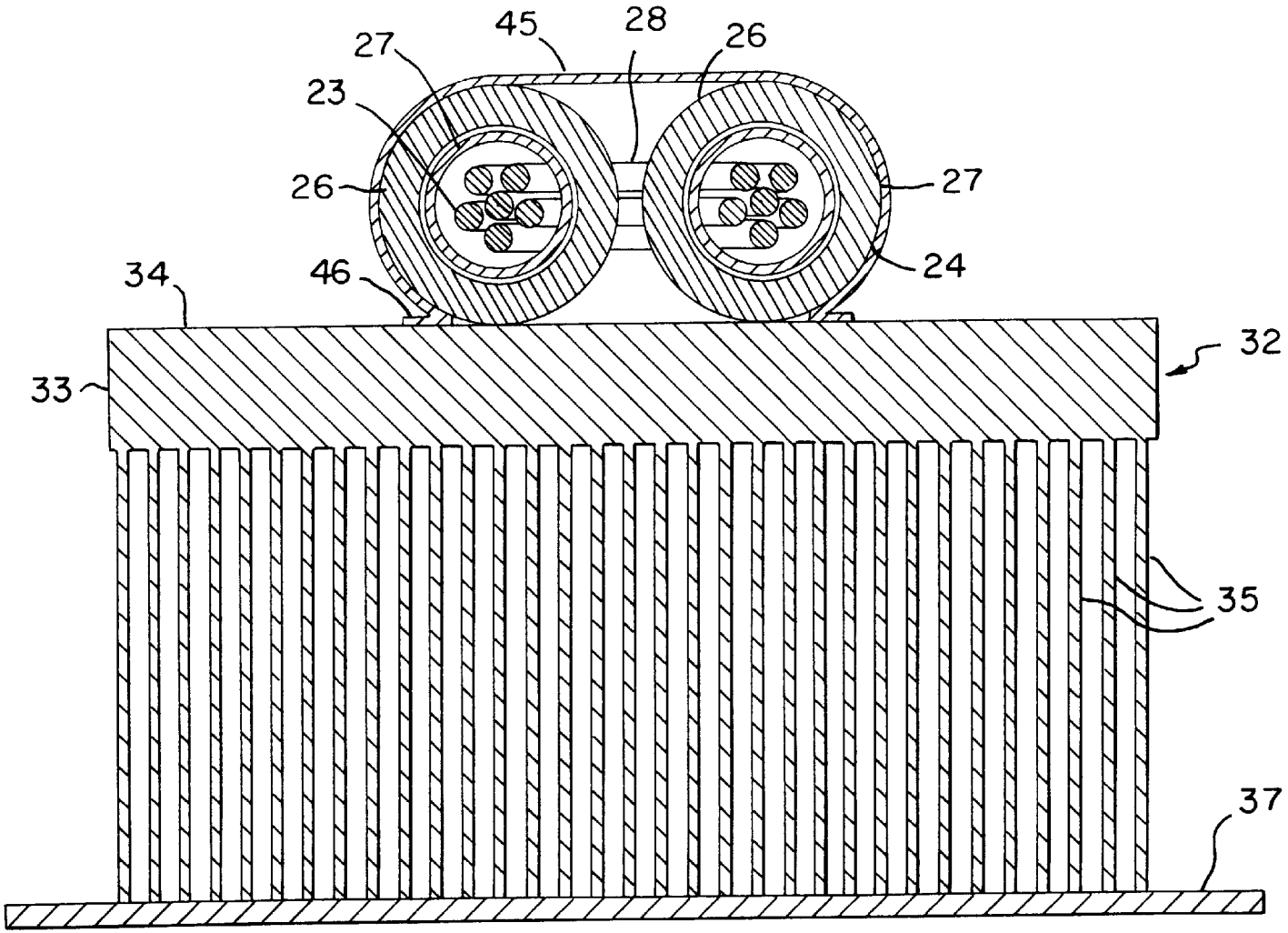
FIG. 5 is a cross-sectional view through the coaxial winding transformer structure of FIG. 3, taken generally along the line 5—5 of FIG. 3.

With reference to the drawings, a coaxial winding transformer structure with cooling in accordance with the present invention is shown generally at 21 in FIG. 3. The structure 21 includes a coaxial winding transformer 22 having (as best shown in FIGS. 5–9) an inner winding conductor 23, an outer winding conductor 24, a space 25 between the inner and outer conductors which may be filled with an electrically insulating material, and toroidal magnetic cores 26 mounted around two straight tubular leg sections 27 of the outer conductor 24 of the coaxial winding transformer. The inner and outer conductors 23 and 24 are formed of a good electrical conductor, such as copper. The inner conductor 23 extends coaxially within and is insulated from the cylindrical leg sections 27 of the outer conductor, which may be formed of copper tubing. The inner conductor is electrically insulated from the outer conductor, for example, by being formed of copper wire with plastic insulation on the wire, and has straight sections within the tubular leg sections 27 and a bend (or bends) 28 connecting these straight sections. Semicylindrical portions 29 of the outer conductor extend from the straight leg sections 27 of the outer conductor, and have a surface area available for heat transfer and electrical contact, for example, at the outer periphery of the conductor sections 29. The sections 29 are preferably made of thin sheet metal (e.g., electrical grade copper) integrally with the tubular leg sections 27, and are formed in a semicylindrical shape, although the extending sections 29 may be more or less than half a cylinder, and can be flattened or bent. The leg sections can be formed by stamping the required material for the straight sections 27 and the portions 29 out of flat sheet copper and then rolling the stamped metal into the desired tubular shape and welding or brazing overlapped edges. In general, it is preferred that all the sheet metal parts be precut to reduce the number of components and the assembly steps. The inner diameter of the cores 26 is preferably only slightly larger than the outside diameter of the legs of the outer conductor 24, as generally illustrated in FIG. 5. The extending sections 29 extend outwardly from the leg sections 27 at (preferably) both the closed end and the open end of the transformer. As illustrated in FIG. 3, at one end of the transformer a section of the outer conductor 27, formed as a conducting strap 30 (e.g., formed of thin sheet copper), is mounted around the exposed available surfaces of the extending sections 29 in good electrical and heat transfer contact with the surfaces of the sections in these areas, completing the electrical connection between the straight leg sections 27 and allowing transfer of heat to the strap 30 from the extending sections 29 through the relatively large area of the strap 30 which is in contact with the sections 29.

Figure 4:
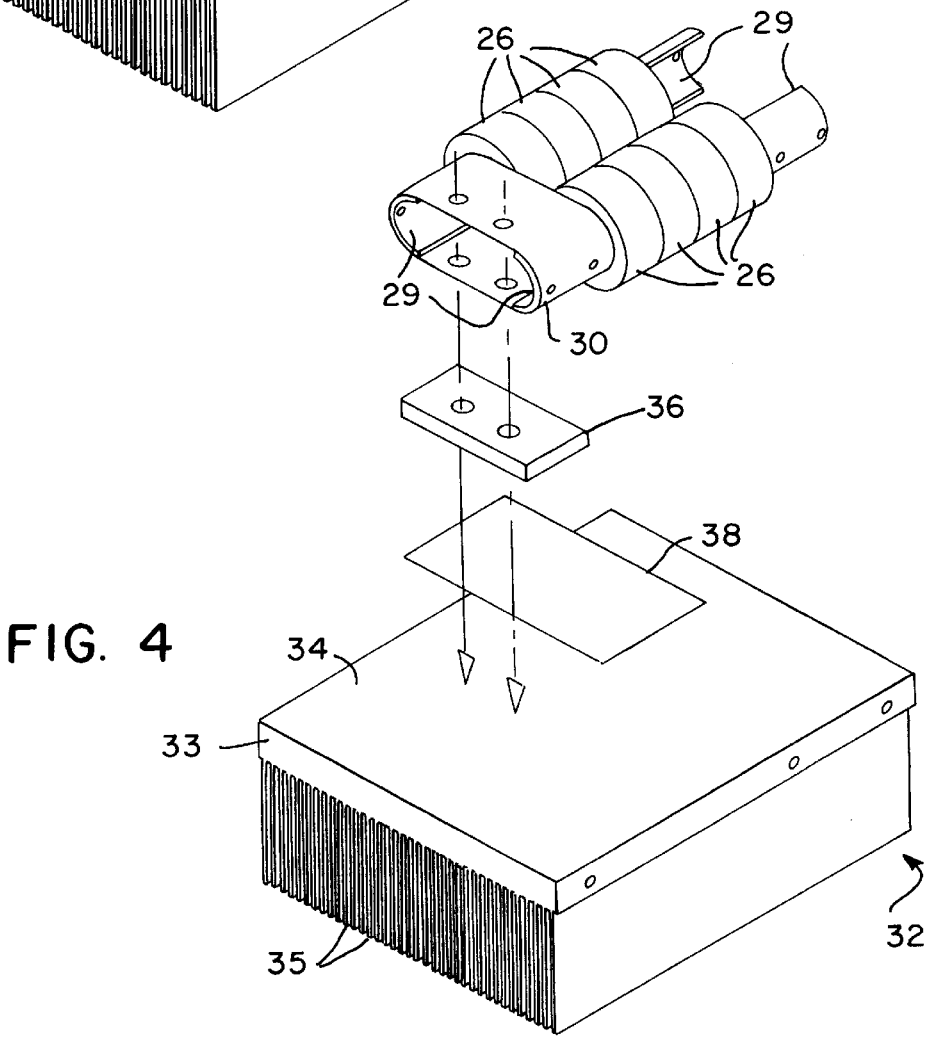
FIG. 4 is an exploded view of the coaxial winding transformer structure of FIG. 3 showing the parts thereof as they would be assembled.
Figure 12:
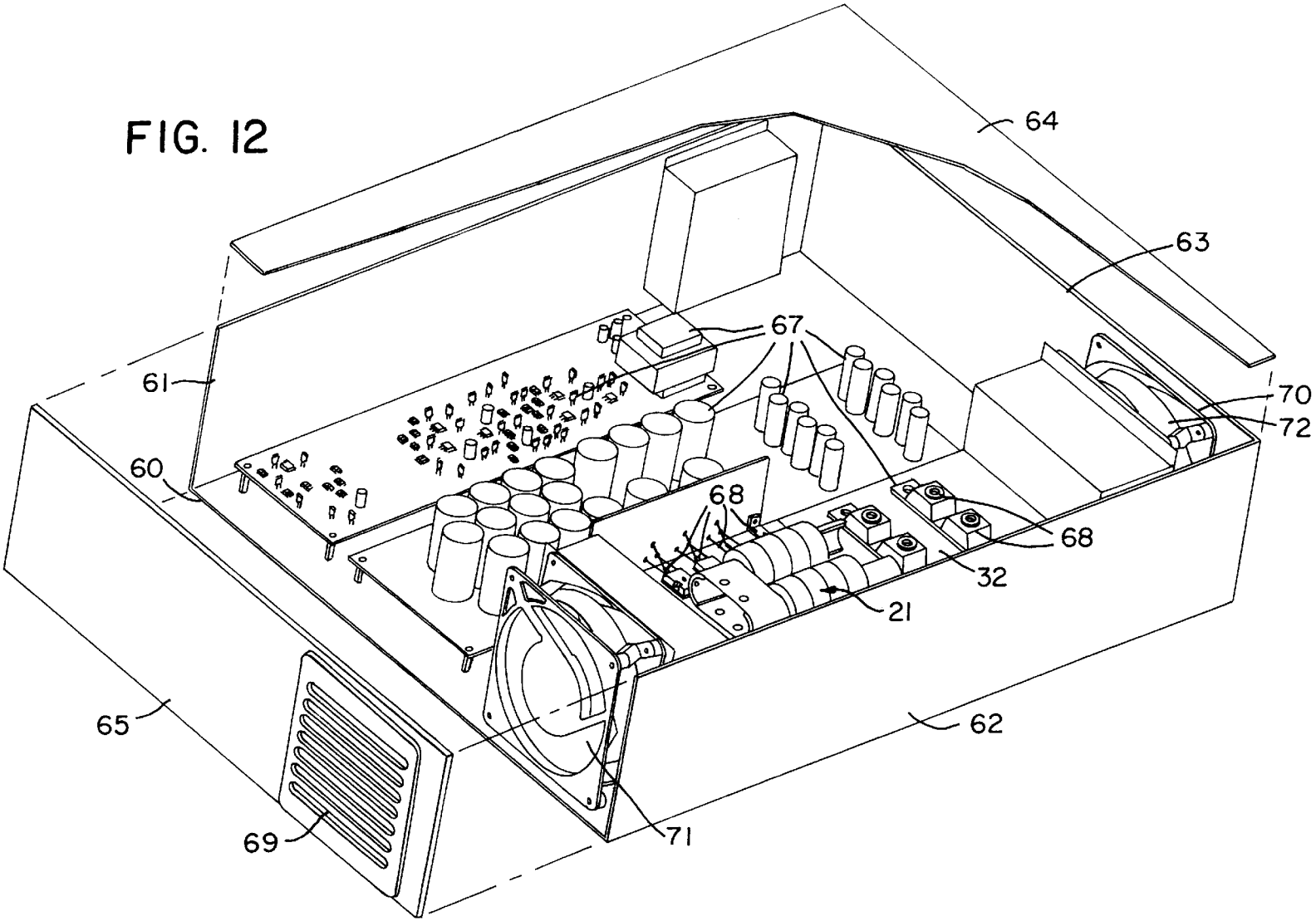
FIG. 12 shows a partially broken away perspective view of a typical electronic system in which the transformer structure of the present invention may be incorporated.

As shown in FIGS. 3–5, the coaxial winding transformer structure with cooling of the present invention may include a heat sink 32 to which heat dissipated in the transformer 22 is transferred. The heat sink 32 is formed of a good heat conducting metal, such as copper, aluminum, etc., and preferably has a base portion 33, constructed as a solid block of material with large area surface 34 available to receive heat, and multiple cooling fins 35 extending from the surface of the base 33 opposite the surface 34. The fins 35, which may be formed integrally with the base 33, provide a large surface area for transfer of heat to the ambient air as air moves past the fins 35. It is preferred that a heat sink 32 with fins 35 for dissipating heat to air at a position away from the transformer be utilized, although it is understood that the heat sink may comprise the cabinet enclosure, an active heat exchanger, or the cold plate of a refrigeration unit if desired. It is also apparent that the heat sink 32 may be shared with other circuit components 68 as illustrated in FIG. 12. The heat sink 32 can be in contact with, and, if desired, supported by, an electrical insulating layer 37 as shown in FIG. 5, e.g., a phenolic insulator material, to electrically insulate the heat sink from the metal walls of a cabinet enclosure (not shown in FIG. 5). By insulating the heat sink from other components, the outer conductor 24 and the heat sink 32 may be directly connected by heat transfer members that also happen to be good electrical conductors (which is typically the case). The heat sink may also be formed in two or more sections which are electrically insulated from one another. Where such a multi-part heat sink is utilized, heat transfer members may be directly connected from different parts of the outer conductor directly to the electrically insulated sections of the heat sink. If a one piece heat sink is to be used, or if heat transfer members are to be connected from different positions on the outer conductor to one section of a multi-section heat sink, then only one of the heat transfer members may be directly connected to the heat sink and the others must be connected through an electrically insulating layer so as not to short out the outer conductor. If desired for maximum heat transfer, each of several heat transfer members connected to the outer conductor may be directly connected to its own heat sink which is electrically insulated from all other heat sinks and from the chassis.

A conductive heat transfer path is formed from the outer conductor 24 of the coaxial winding transformer through one or more heat transfer members on a heat transfer path to the available surface of the heat sink. It is preferred that the transformer 22 be located closely adjacent to the heat sink 32 to minimize the length of the heat transfer path. The outer conductor sections 27 and 30 are in good heat transfer and electrical contact with one another, so that heat built up in the straight sections 27, for example, will be conducted to the strap member 30. One heat transfer path preferably extends from a flat portion of the strap 30 to a cooling block 36 formed of a good heat transfer metal such as copper or aluminum, and thence to the available surface 34 of the heat sink 32, either directly or through a layer 38 of a heat conductive but electrically insulating polymer. Although several heat transfer members may form the heat transfer path from the strap 30 of the outer conductor 24, it is apparent that a single integrally formed heat transfer member may be used, if desired. In addition, the strap 30 may itself function as a heat transfer member and be in direct contact with the surface 34 of the heat sink, or in contact through an intervening electrically insulating layer only, or the extending sections 29 may be flattened and bent down to make contact with the surface 34 of the heat sink through an electrically insulating layer without the use of other intervening members.

The insulating layer 38, which may be an element of the heat transfer path from the transformer to the heat sink, may be made of various materials that combine the qualities of good heat conduction and good electrical insulation. Preferably, the layer 38 is relatively thin (e.g., 0.0025 inch thickness) and has relatively large opposite surface areas in contact with the adjacent heat transfer member and the heat sink to facilitate the rate of flow of heat across the electrical insulating layer. Examples of materials that can be used for the electrically insulating element 38 include Kapton (trademark) polyimide film, treated to improve heat transfer and electrical insulation properties, available from Power Devices, Inc., under the name Isostrate, and silicon rubber and fiberglass components, available from the Bergquist Company under the name Sil-Pad (trademark). Other insulating materials, such as thermal greases and mica, and thermal interfaces available from the Bergquist Company under the name SoftFace (trademark), may also be utilized.

Figures 6, 6A:
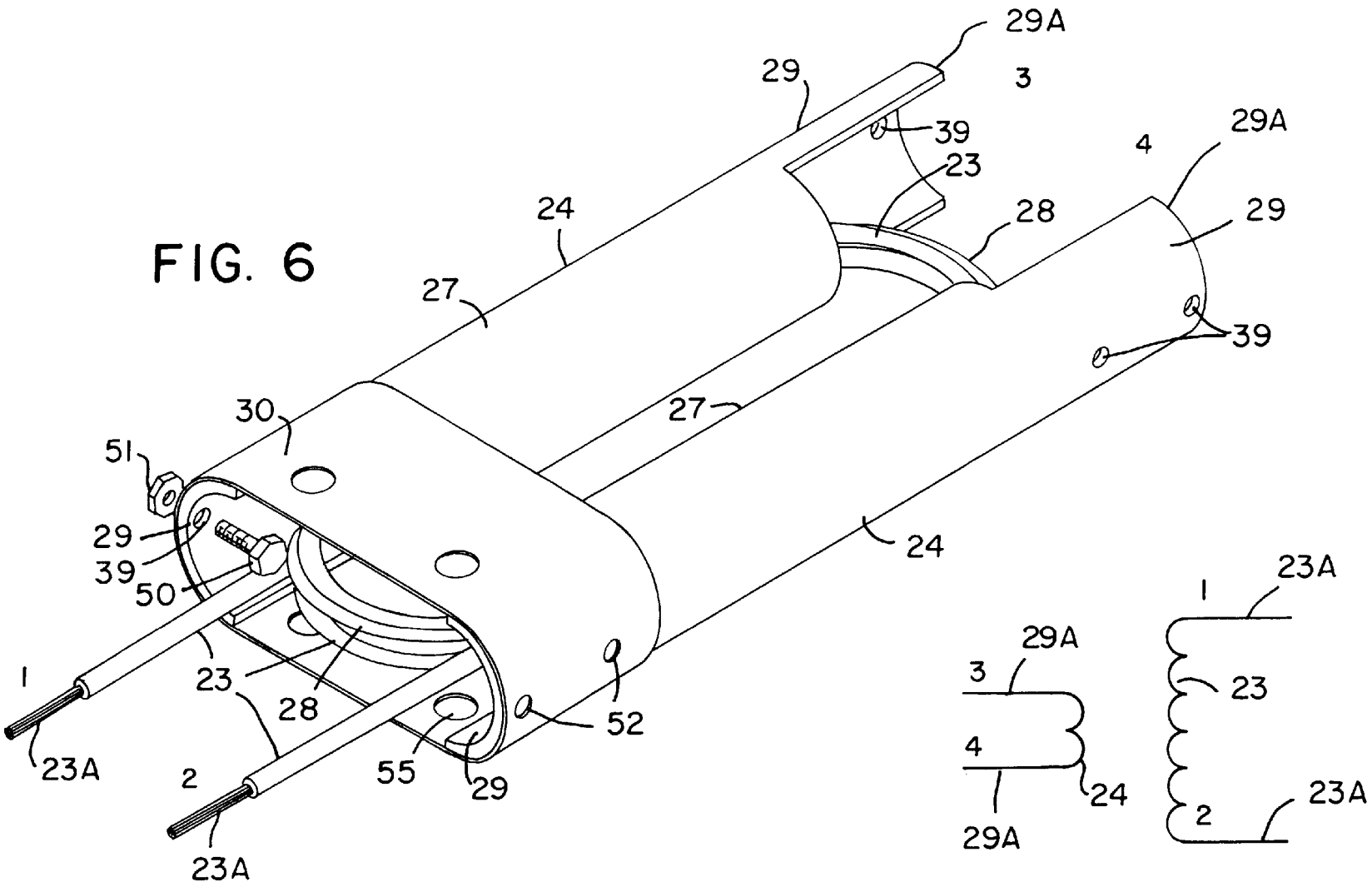
FIG. 6 is a perspective view showing the inner and outer conductors of the coaxial winding transformer.
FIG. 6A is a schematic illustrating the transformer windings for the transformer of FIG. 6.

For purposes of illustration, the inner conductor 23 and outer conductor 24 of the coaxial transformer 22 are shown by themselves in FIG. 6. In contrast to the typical U-shaped coaxial winding transformer 11 illustrated in FIGS. 1A and 1B, the outer conductor 24 is formed of the two separated straight leg sections 27 which are electrically connected at one of their ends by the strap 30. The inner conductor 23 (which may have multiple turns as shown) has a bend 28 (or bends 28 at each end, where the inner conductor has multiple turns) formed in it which is not enclosed by the tubular leg sections of the outer conductor 24. Because the outer conductor 24 is formed of the two straight legs sections 27 and the strap 30, the winding of multiple turns of inner conductor through the tubes 27 is relatively easy. The ends 23A of the inner conductor 23 and the ends 29A of the outer conductor form the terminals of the transformer, as illustrated in FIG. 6A. The terminal ends 23A of the inner conductor may be located at either the closed or open end of the transformer.

This type of transformer construction has somewhat more leakage inductance than the transformer of FIGS. 1A and 1B, but this additional leakage is generally relatively small (less than 10%). It is apparent that the present invention may be embodied in a coaxial winding transformer having an outer conductor enclosing the bends 28 in the inner conductor—for example, by connecting a bent tubular conductor to the ends of the straight conductor sections 27. Alternatively, heat transfer members may be mounted in contact with the outer surfaces of a U-shaped outer conductor to transfer heat therefrom on a conducting path to the heat sink. A further alternative is to provide extending sections 29 at the open end of the U-shaped transformer and not at the closed end, with these extending sections then being connected by heat transfer members to the heat sink.

Figure 7:
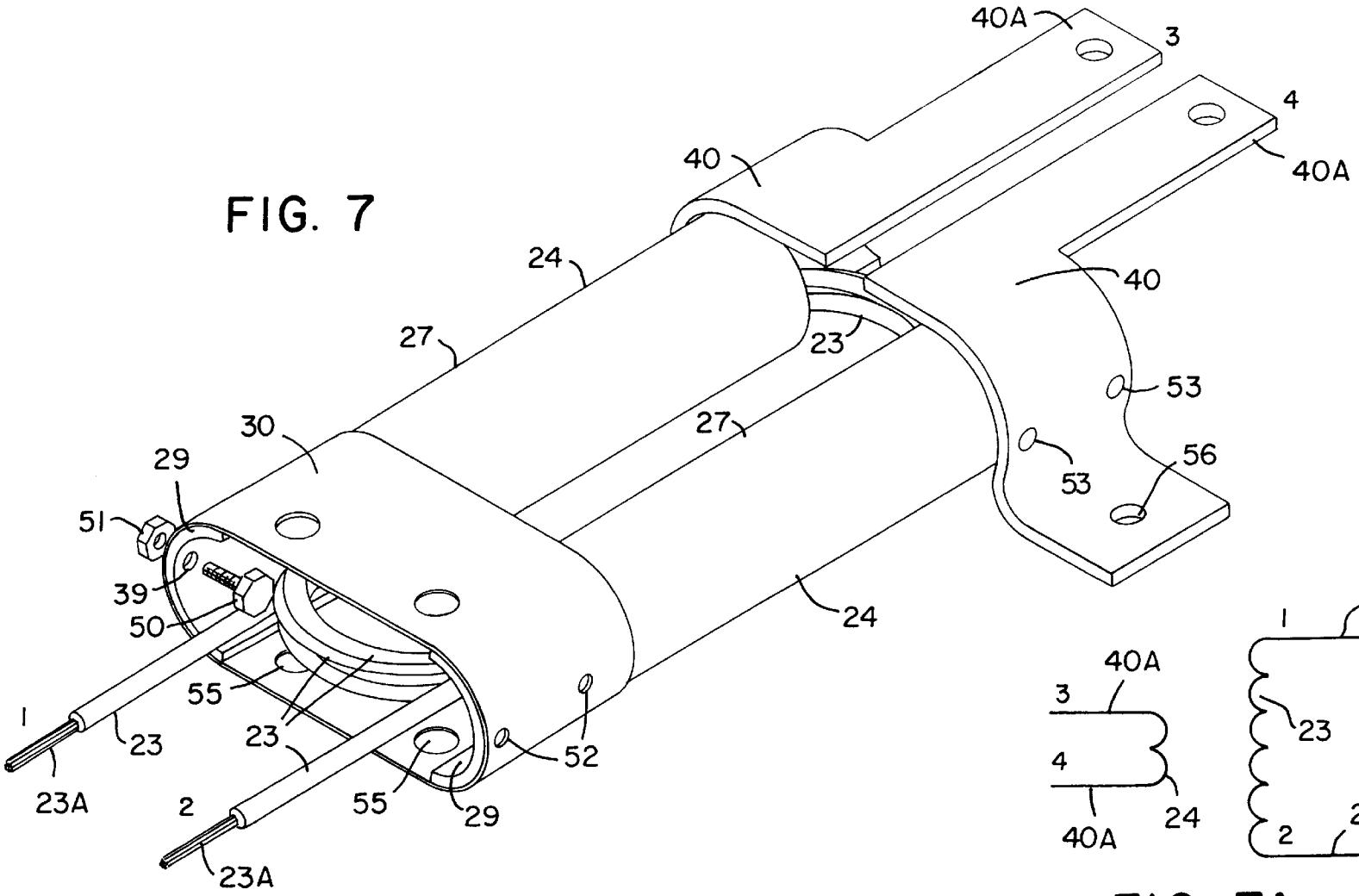
FIG. 7 is a perspective view of the transformer conductors of FIG. 6 with heat transfer terminations connected thereto.
Figure 7A:
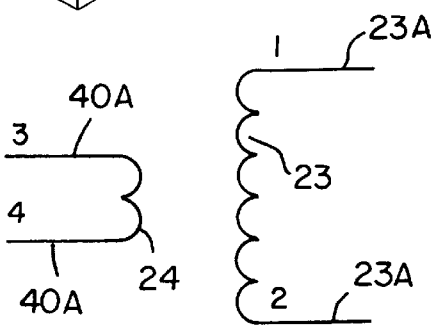
FIG. 7A is a schematic illustrating the transformer windings for the transformer of FIG. 7.

Also illustrated in FIG. 6 are holes 39 which may be formed in the extending sections 29 to allow these sections to be secured by fasteners (as illustrated at 50, 51) to the conducting strap 30. As shown in FIG. 7, similar fasteners may be used to connect straps 40 (e.g., formed of sheet copper) to the extending sections 29 at the open end of the transformer. The strap 30 has holes 52 therein and the strap 40 has holes 53 therein to allow them to be fastened to the extending sections 29 by fasteners (not shown) similar to the bolt 50 and not 51. The strap 30 also has holes 55 to allow the strap to be fastened to another heat transfer member or to the heat sink. A hole 56 is formed in a flat base section of the strap 40 to allow it to be connected to the heat sink, so that heat can be transferred from both ends of the transformer. Where the straps 40 are used, the ends 40A of the straps can be used as the electrical terminals for the outer conductor 24, as illustrated in FIG. 7A.

Figure 8:
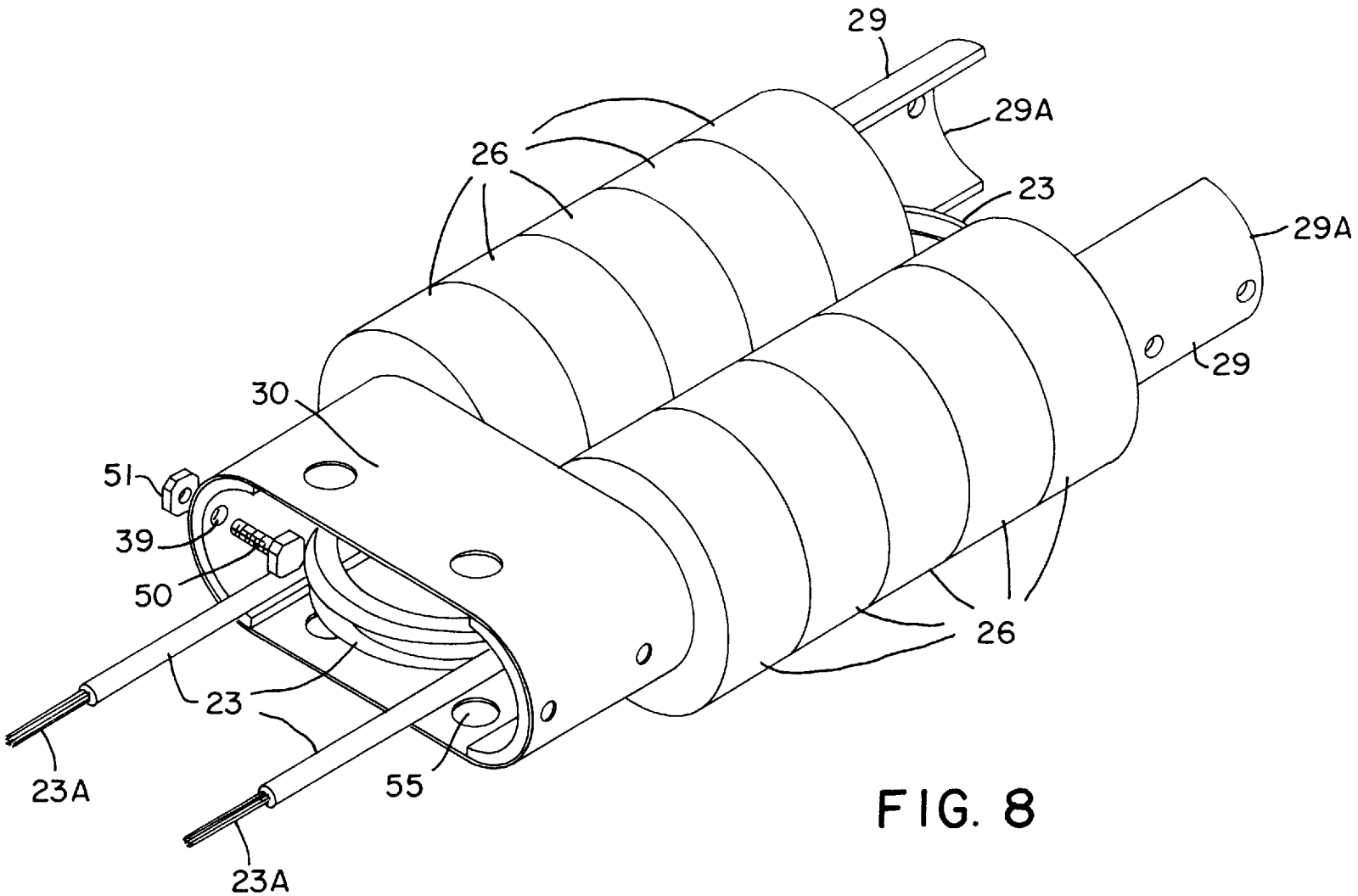
FIG. 8 is a perspective view of the transformer of FIG. 6 with magnetic cores mounted thereon.
Figure 9:
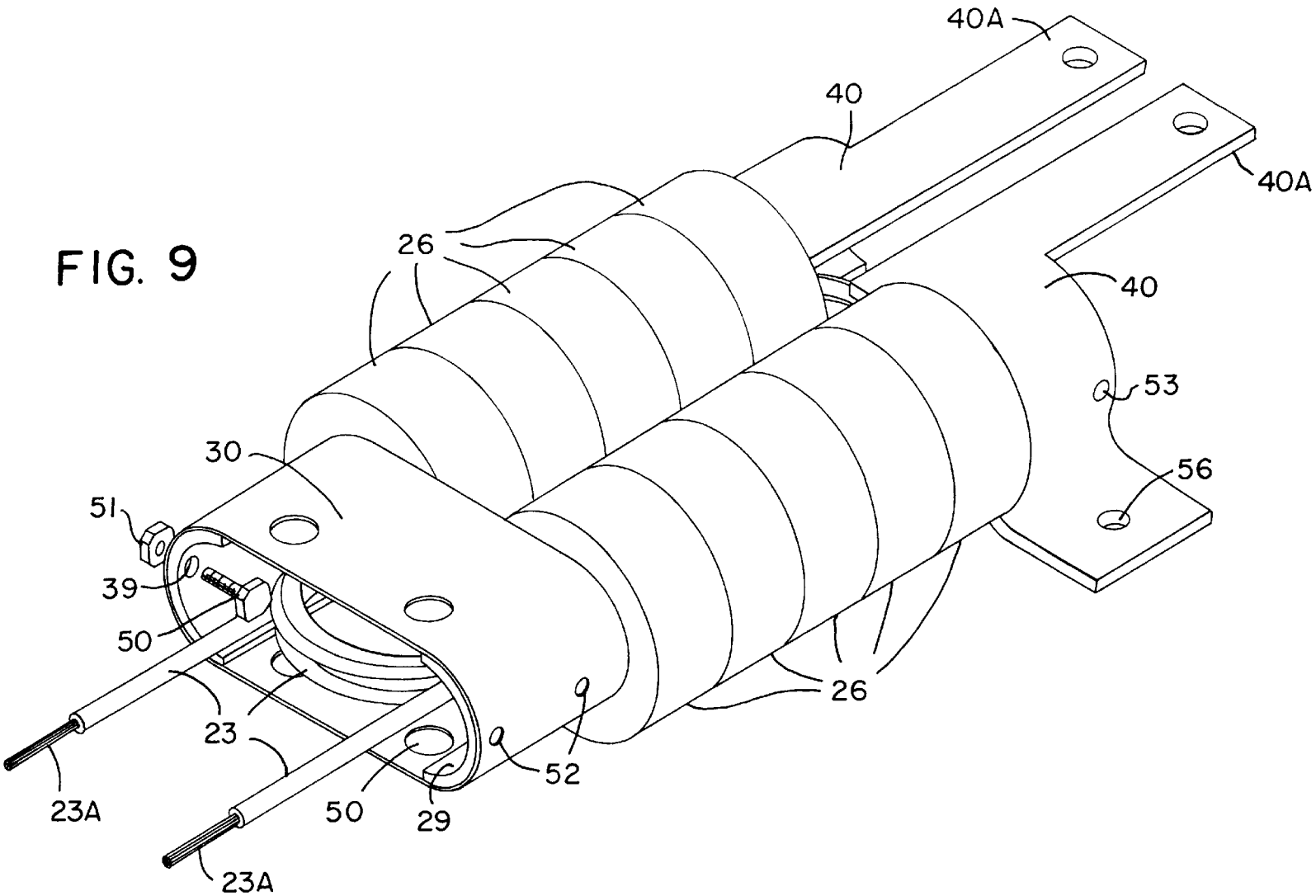
FIG. 9 is a perspective view of the transformer of FIG. 7 with magnetic cores mounted thereon.

FIGS. 8 and 9 illustrate the coaxial transformer constructions of FIGS. 6 and 7, respectively, with the magnetic cores 26 in place.

Figure 10:
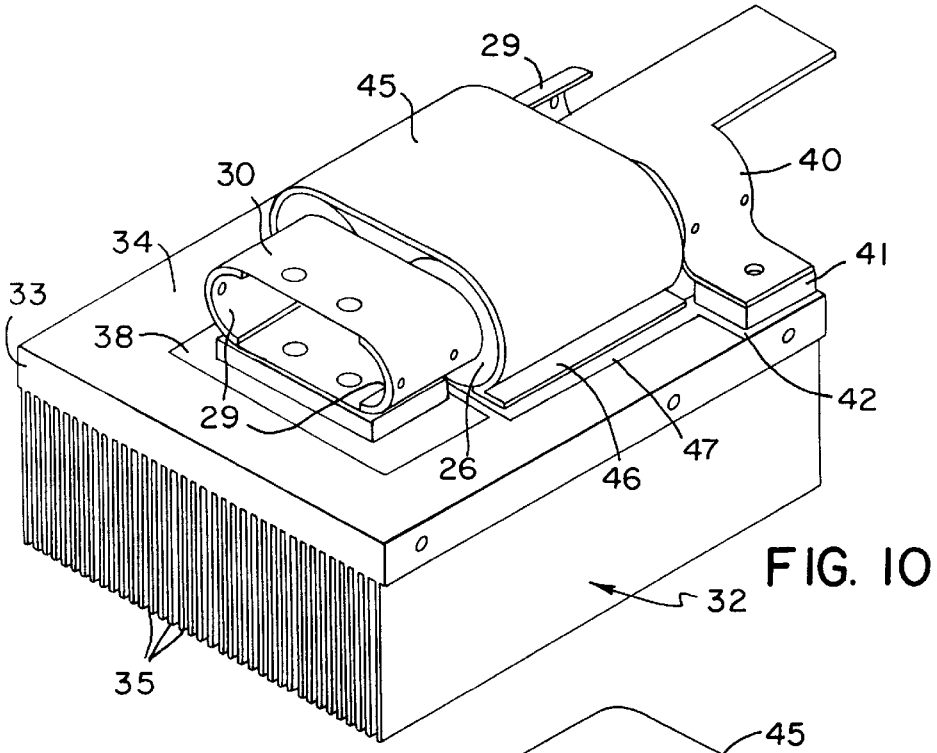
FIG. 10 is a perspective view of a coaxial winding transformer structure with cooling in accordance with the present invention including a strap member mounted to provide a heat transfer path from the magnetic cores of the transformer to the heat sink.
Figure 11:
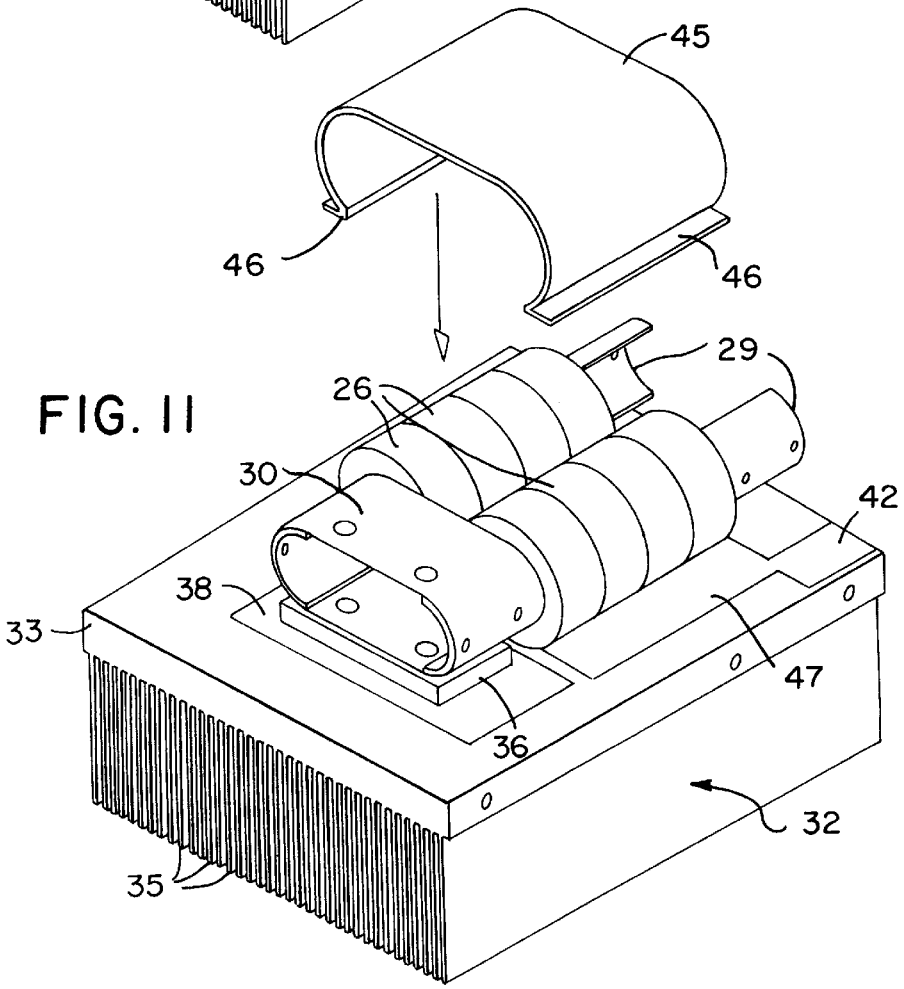
FIG. 11 is an exploded view of the transformer structure of FIG. 10 illustrating the manner in which the heat transfer strap member is assembled over the magnetic cores.

FIG. 10 illustrates additional preferred structure for the coaxial winding transformer with cooling of the invention. The heat conducting terminal strap 40 (one shown, although two straps 40 are generally used, one for each terminal) is mounted to the surfaces of the conductor section 29 that extend from the end of the transformer opposite to that to which the strap 30 is mounted. The strap 40, in a manner similar to the strap 38, is in good heat transfer and electrical contact over the outer periphery of the exposed portion of the section 29, and is in contact with a heat transfer block 41 which is itself mounted directly to the heat sink surface 34 or on a layer 42 of heat conductive, electrically insulating material (as described above) that is in contact with the surface 34 of the heat sink 32. In this manner, heat is transferred from the outer conductor 24 at both ends of the transformer to maximize the rate of heat flow. In addition, a heat transfer strap 45 may be mounted over the magnetic cores 26 to be in good heat transfer contact therewith over a substantial portion of their peripheries, with the strap 45 having flat bases 46 on each side of the strap which are in contact—directly or through a heat conducting, electrically insulating layer 47, as desired—with the surface 34 of the heat sink. The strap 45, also formed of a good heat conducting metal such as copper or aluminum, rapidly transfers heat away from the magnetic cores to the heat sink. FIG. 11 shows the manner in which the strap 45 is assembled over the cores 26 to form the completed transformer structure. The strap 45 may be firmly connected to the heat sink, e.g., by welding or brazing the bases 46 to the heat sink surface 34 or by passing bolts (not shown) through the bases 46 into tapped holes in the heat sink. The strap 45 then serves to mechanically secure the entire transformer structure to the heat sink.

The coaxial winding transformer structure of the invention may be used in various electronic systems where the advantages of a coaxial winding transformer are desired. Typical packaging for electronic systems includes a cabinet with openings to allow air flow (possibly with the assistance of fans) across the components in the cabinet. In some situations, it becomes desirable to seal the components inside the cabinet from the outside atmosphere. For purposes of illustration, the coaxial winding transformer structure 21 of the present invention is shown in FIG. 12 mounted with its heat sink 32 within a chassis or enclosure formed of walls 60–65 which are joined together to seal the transformer 21 and other electrical and electronic components 67 and 68 within the enclosure. The components 68 are shown for illustration mounted to the heat sink for cooling of these components. The front wall 65 and back wall 63 may have grilles 69 and 70 mounted therein to allow outside air to be drawn by fans 71 and 72 through the channels between the fins 35 of the heat sink 32, thereby cooling the heat sink without allowing ambient air into the enclosure where it could contact the components 67 and 68. This type of sealed enclosure structure is a particularly suitable application for the present invention, since the coaxial winding transformer 21 is efficiently cooled without allowing air into the enclosure, but the invention may also be used with non-sealed enclosures.

It is understood that the invention is not confined to the particular embodiments set forth herein as illustrative, but embraces all such modified forms thereof as come within the scope of the following claims.

What is claimed is:

1. A coaxial winding transformer structure with cooling comprising:

(a) a coaxial transformer outer conductor including a tubular section and a coaxial transformer inner conductor extending coaxially within the tubular section of the outer conductor and being insulated therefrom;

(b) a heat sink having a surface available to receive heat;

(c) at least one heat transfer member formed of a good heat conductor in good heat transfer contact with the outer conductor, the heat transfer member forming a heat transfer path to conduct heat from the outer conductor to the available surface of the heat sink, wherein the heat transfer member includes a heat conducting and electrically insulating element therein to provide electrical isolation between the transformer and the heat sink.

2. The coaxial winding transformer of claim 1 wherein the heat sink includes a solid metal base, one surface of which is the surface of the heat sink available to have heat transferred thereto from the coaxial winding transformer, and wherein the heat sink has a plurality of fins extending from a surface of the base opposite to the available surface, the fins having large surface areas by which heat may be dissipated therefrom to air passing between the fins.

3. A coaxial winding transformer structure with cooling comprising:

(a) a coaxial transformer outer conductor including a tubular section and a coaxial transformer inner conductor extending coaxially within the tubular section of the outer conductor and being insulated therefrom;

(b) a heat sink having a surface available to receive heat;

(c) at least one heat transfer member formed of a good heat conductor in good heat transfer contact with the outer conductor, the heat transfer member forming a heat transfer path to conduct heat from the outer conductor to the available surface of the heat sink, wherein the outer conductor has two straight tubular leg sections and a member electrically connecting the leg sections, and in heat transfer contact therewith, and the inner conductor extends through the straight leg sections of the outer conductor and has a bend connecting the portions of the inner conductor extending through the straight leg sections of the outer conductor, and including a heat transfer member in contact with the member connecting the two straight leg sections to conduct heat from each leg section to the at least one heat transfer member and thence to the available surface of the heat sink.

4. The coaxial winding transformer structure of claim 3 wherein the straight leg sections of the outer conductor are cylindrical and wherein semicylindrical sections extend from the straight leg sections, and wherein the member connecting the straight leg sections comprises a metal conducting strap mounted in contact with surfaces of the semicylindrical extending sections to complete electrical conduction between the two straight leg sections and to have heat transferred thereto from the surfaces of the semicylindrical portions.

5. The coaxial winding transformer structure of claim 4 wherein the at least one heat transfer member includes a conducting block of good heat conducting metal in contact with a substantial portion of a flat surface of the conducting strap to receive heat therefrom, the conducting block mounted to the available surface of the heat sink with a thin layer of a heat conducting and electrically insulating material mounted between the conducting block and the available surface of the heat sink to allow good heat conduction across the layer from the conducting block to the surface of the heat sink while electrically isolating the heat sink from the outer conductor of the transformer.

6. The coaxial winding transformer structure of claim 4 further including toroidal magnetic cores having an inner diameter conforming to the outer diameter of the straight leg sections and which are mounted over the straight leg sections of the outer conductor.

7. The coaxial winding transformer structure of claim 6 further including a conducting strap formed of a sheet of good heat conducting metal mounted over and in contact with outer surfaces of the magnetic cores to provide large surface area contact between the conducting strap and the magnetic cores to transfer heat from the cores to the conducting strap, the conducting strap extending to base sections thereof which have surface areas mounted to the available surface of the heat sink.

8. The coaxial winding transformer structure of claim 7 further including a layer of heat conducting and electrically insulating material between the base sections of the conducting strap and the available surface of the heat sink to maintain electrical isolation between the magnetic cores and the heat sink.

9. The coaxial winding transformer structure of claim 3 including an electrical insulating layer in contact with the heat sink to support and electrically insulate it.

10. A coaxial winding transformer structure with cooling comprising:

a) a coaxial transformer outer conductor including a tubular section and a coaxial transformer inner conductor extending coaxially within the tubular section of the outer conductor and being insulated therefrom;

(b) a heat sink having a surface available to receive heat;

(c) at least one heat transfer member formed of a good heat conductor in rood heat transfer contact with the outer conductor, the heat transfer member forming a heat transfer path to conduct heat from the outer conductor to the available surface of the heat sink;

wherein the outer conductor has two straight tubular leg sections electrically connected at one of their ends by a conducting member and having semicylindrical sections extending from the other ends of the straight leg sections, including a conducting strap in electrical and heat transfer contact with at least one of the extending sections and mounted to transfer heat to the heat sink.

11. The coaxial winding transformer structure of claim 10 wherein the conducting strap is connected to a metal conducting block to transfer heat to the block, and wherein the block is mounted to the available surface of the heat sink with a layer of heat conducting and electrically insulating material mounted between the conducting block and the available surface of the heat sink to maintain electrical isolation of the heat sink from the outer conductor of the coaxial winding transformer.

12. A coaxial winding transformer structure with cooling comprising:

(a) a coaxial transformer outer conductor comprising two straight tubular leg sections and an electrical and heat conducting member electrically connecting the leg sections and in heat transfer contact therewith, and a coaxial transformer inner conductor extending coaxially within the leg sections of the outer conductor and being insulated therefrom, the inner conductor having portions extending through the straight leg sections of the outer conductor and having a bend connecting the portions of the inner conductor extending through the straight leg sections;

(b) at least one heat transfer member formed of a good heat conductor in good heat transfer contact with the outer conductor, the at least one heat transfer member forming a heat transfer path to conduct heat from the outer conductor to a position away from the outer conductor, wherein the straight leg sections of the outer conductor are cylindrical and wherein semicylindrical sections of the outer conductor extend beyond the straight leg sections, and wherein the member connecting the straight leg sections comprises a metal conducting strap mounted in contact with the surfaces of the extending semicylindrical sections to make electrical and heat transfer contact with the surfaces of the semicylindrical sections.

13. The coaxial winding transformer structure of claim 12 wherein at least one heat transfer member includes a conducting block of good heat conducting metal in contact with a substantial portion of the surface of the conducting strap to receive heat therefrom.

14. The coaxial winding transformer structure of claim 12 wherein the at least one heat transfer member includes an electrically insulating and heat conductive element.

15. The coaxial winding transformer structure of claim 12 further including toroidal magnetic cores having an inner diameter conforming to the outer diameter of the straight leg sections and mounted over the straight leg sections of the outer conductor.

16. The coaxial winding transformer structure of claim 15 further including a conducting strap formed of a thin sheet of good heat conducting metal mounted over and in contact with outer surfaces of the magnetic cores to provide a large surface area contact between the conducting strap and the magnetic cores to transfer heat from the cores to the conducting strap, the conducting strap extending to base sections thereof which have surface area.

17. The coaxial winding transformer structure of claim 12 including semicylindrical sections extending from the tubular leg sections at the ends of the leg sections opposite to that to which the electrical and heat conducting connecting member is connected, and a conducting strap in electrical and heat transfer contact with at least one of the extending sections.

* * * * *

UNITED STATES PATENT AND TRADEMARK OFFICE

CERTIFICATE OF CORRECTION

PATENT NO. : 6,087,916
DATED : July 11, 2000
INVENTOR(S) : Kutkut, et al.

It is certified that error appears in the above-identified patent and that said Letters Patent is hereby corrected as shown below:

Column 10, claim 10,
Line 16, delete "rood" and insert in its place -- good --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*